US011834781B2

(12) United States Patent
Mao et al.

(10) Patent No.: US 11,834,781 B2
(45) Date of Patent: Dec. 5, 2023

(54) METHOD OF CONTINUOUS DYEING WITH REACTIVE DYES IN WET CONDITIONS

(71) Applicants: HUAFANG Co., Ltd., Binzhou (CN); Donghua University, Shanghai (CN); Binzhou Hua Textile Engineering Technology Research Institute Co., Ltd., Binzhou (CN)

(72) Inventors: Zhiping Mao, Binzhou (CN); Hongyu Sun, Binzhou (CN); Chunguang Li, Binzhou (CN); Rongxia Jia, Binzhou (CN); Yi Zhong, Binzhou (CN); Hong Xu, Binzhou (CN); Limin Wang, Binzhou (CN); Qi Yu, Binzhou (CN); Xiaomin Liu, Binzhou (CN); Qingbo Lu, Binzhou (CN); Chunying Sheng, Binzhou (CN); Engang Lu, Binzhou (CN); Qisheng Zhao, Binzhou (CN); Wei Wu, Binzhou (CN); Yamin Dai, Binzhou (CN); Jinbo Wang, Binzhou (CN)

(73) Assignees: HUAFANG CO., LTD, Binzhou (CN); DONGHUA UNIVERSITY, Shanghai (CN); BINZHOU HUA TEXTILE ENGINEERING TECHNOLOGY RESEARCH INSTITUTE CO., LTD., Binzhou (CN)

( * ) Notice: Subject to any disclaimer, the term of this patent is extended or adjusted under 35 U.S.C. 154(b) by 311 days.

(21) Appl. No.: 17/381,175

(22) Filed: Jul. 20, 2021

(65) Prior Publication Data

US 2021/0348329 A1 Nov. 11, 2021

Related U.S. Application Data

(63) Continuation-in-part of application No. PCT/CN2020/000151, filed on Jul. 15, 2020.

(30) Foreign Application Priority Data

Nov. 7, 2019 (CN) ..... 201911081088.3

(51) Int. Cl.

| | |
|---|---|
| ***D06P 5/00*** | (2006.01) |
| ***D06P 1/38*** | (2006.01) |
| ***D06P 5/20*** | (2006.01) |

(52) U.S. Cl.

CPC ..... *D06P 1/38* (2013.01); *D06P 5/2077* (2013.01)

(58) Field of Classification Search

CPC ..... D06P 1/38; D06P 5/2077; D06P 1/0032; D06P 1/384

(Continued)

(56) References Cited

U.S. PATENT DOCUMENTS 4,349,349 A * 9/1982 Nakatsuka ..... C09B 67/0073 8/549
6,530,961 B1 * 3/2003 Schrell ..... D06P 3/66 8/618

FOREIGN PATENT DOCUMENTS

CN 105780549 A * 7/2016 ..... D06M 13/432

* cited by examiner

*Primary Examiner* — Eisa B Elhilo
(74) *Attorney, Agent, or Firm* — MATTHIAS SCHOLL P.C.; Matthias Scholl

(57) ABSTRACT

The disclosure provides a method of continuous dyeing with reactive dyes in wet conditions, the method including: 1) adding fabric to a mixture of a dye liquor and an alkali through a one-bath-one-step method; 2) immersing the fabric pretreated in 1) in a padding liquor with an air film horizontal pad dyeing machine; 3) preheating the fabric after being treated in 2) at a temperature of 50-90° C.; and 4) rolling and batching the fabric after being treated in 3) at a temperature of 10-70° C. for 2-72 hours.

11 Claims, 1 Drawing Sheet

(58) Field of Classification Search
USPC ..... 8/549
See application file for complete search history.

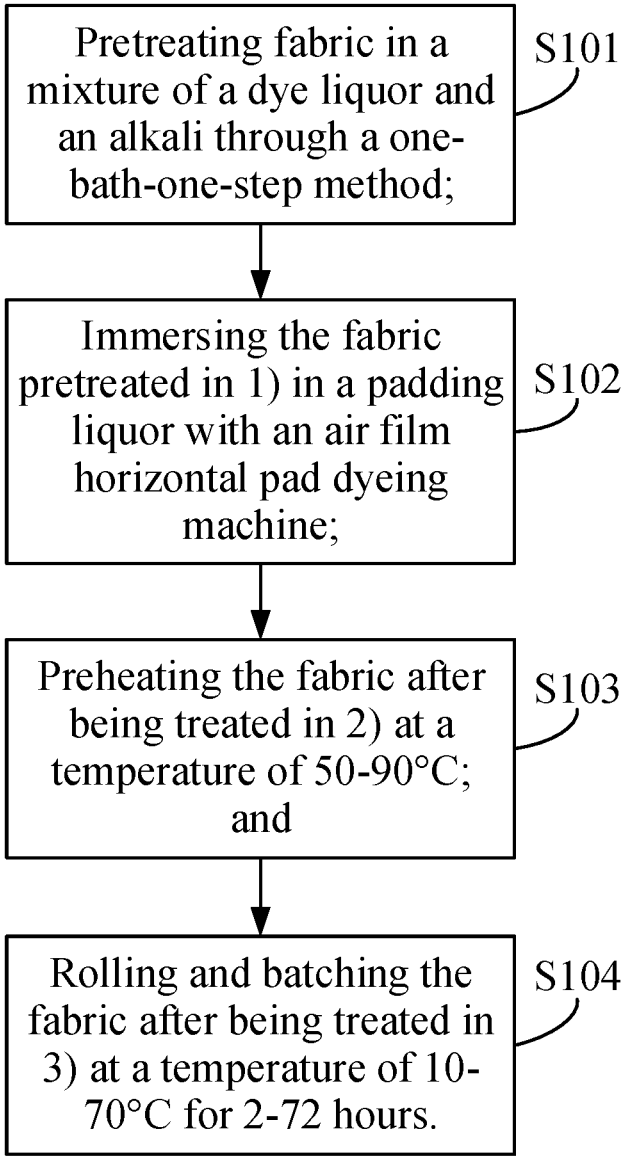
Pretreating fabric in a mixture of a dye liquor and an alkali through a one-bath-one-step method;
S101
Immersing the fabric pretreated in 1) in a padding liquor with an air film horizontal pad dyeing machine;
S102
Preheating the fabric after being treated in 2) at a temperature of 50-90°C; and
S103
Rolling and batching the fabric after being treated in 3) at a temperature of 10-70°C for 2-72 hours.
S104

METHOD OF CONTINUOUS DYEING WITH REACTIVE DYES IN WET CONDITIONS

CROSS-REFERENCE TO RELATED APPLICATIONS

This application is a continuation-in-part of International Patent Application No. PCT/CN2020/000151 with an international filing date of Jul. 15, 2020, designating the United States, now pending, and further claims foreign priority benefits to Chinese Patent Application No. 201911081088.3 filed Nov. 7, 2019. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, Mass. 02142.

BACKGROUND

The disclosure relates to a method of continuous dyeing with reactive dyes in wet conditions.

Conventionally, cellulose fibers and their blended or interwoven fabrics cellulose fibers are dyed in reactive dyes through pad-dry-pad-steam dyeing process or cold pad-batch process. The pad-dry-pad-steam dyeing process consumes a large amount of inorganic salt, alkali, and steam, and the inorganic salt is difficult to remove. In addition, the process procedure is long, complex, and costly. The alkali involved in the cold pad-batch process includes caustic soda, soda ash, and water glass. The water glass is insoluble in cold water. There are many components in the alkali, including but not limited to caustic soda, soda ash, and water glass, which leads to poor dyeing reproducibility and large quality fluctuations.

SUMMARY

The disclosure provides a method of continuous dyeing with reactive dyes in wet conditions, the method comprising:

1) adding fabric to a mixture of a dye liquor and an alkali through a one-bath-one-step method;

2) immersing the fabric pretreated in 1) in a padding liquor with an air film horizontal pad dyeing machine;

3) preheating the fabric after being treated in 2) at a temperature of 50-90° C.; and 4) rolling and batching the fabric after being treated in 3) at a temperature of 10-70° C. for 2-72 hours.

In a class of this embodiment, the method further comprises washing with water, soaping, washing with water, and drying the fabric after being treated in 4).

In a class of this embodiment, the dye liquor is an activated dye liquor, and the alkali is a color-fixation alkali.

In a class of this embodiment, the activated dye comprises at least two active groups, for example, bis(vinylsulphonyl).

In a class of this embodiment, the addition amount of the activated dye is 1-80 g/L; and the addition amount of the color-fixation alkali is 10-80 g/L, particularly, 15-35 g/L.

In a class of this embodiment, in 2), the liquid carrying rate of the fabric is set between 45 and 75%.

In a class of this embodiment, in 3), the method further comprises examining the preheating effect of the fabric; if the moisture content of the preheated fabric is 5-40%, the preheated fabric is qualified. Particularly, the moisture content of the preheated fabric is 15-30%.

In a class of this embodiment, in 4), the fabric is batched at a temperature of 35-50° C. for 4-24 hours.

The following advantages are associated with the method of continuous dyeing with reactive dyes in wet conditions of the disclosure:

1. Compared with the conventional padding-drying-padding-steaming process, the method of the disclosure comprises padding, preheating and rolling, which shortens the process flow, reduces steam consumption, reduces equipment unit and cost.

2. In the method of the disclosure, the activated dye liquor and the color-fixation alkali are added in one bath thus reducing the usage of the inorganic salt.

3. In the method of the disclosure, the moisture content of the preheated fabric is 15-30%, and the fabric contains no free water, thus preventing the migration of the dye and avoiding the color difference of the fabric.

4. In the method of the disclosure, the moisture content of the preheated fabric is 15-30%, and the fabric contains no free water. Thus, no free water exists at the seam head of the fabric, there is no seam head printing phenomenon, and the fabric has no seam head printing defects.

5.In the method of the disclosure, the moisture content of the preheated fabric is 15-30%, and the fabric contains no free water. Thus, the fabric roll does not need to rotate continuously thus saving the energy consumption.

6. In the method of the disclosure, the moisture content of the preheated fabric is 15-30%, and the fabric contains no free water. Thus, the dye fixation rate is increased, and the color of the fabric is deep.

7. In the method of the disclosure, no special temperature is required for the batching environment, that is, the batching can be implemented in a wide temperature range. The fluctuation of the batching environment temperature can be compensated by adjusting the batching time. When the batching environment temperature is high, the batching time can be shortened; when the batching environment temperature is low, the batching time can be increased. The batching time is adjusted according to the batching environment temperature to achieve the dyeing effect of the fabric.

8. Compared with the conventional pad-dry-pad-steam dyeing process, the method of the disclosure has the advantages of short process flow, simple operation and high work efficiency.

BRIEF DESCRIPTION OF THE DRAWINGS

The disclosure is described hereinbelow with reference to accompanying drawings, in which the sole FIGURE is a flow chart of a method of continuous dyeing with reactive dyes in wet conditions according to one embodiment of the disclosure.

DETAILED DESCRIPTION

To further illustrate, embodiments detailing a method of continuous dyeing with reactive dyes in wet conditions are described below. It should be noted that the following embodiments are intended to describe and not to limit the disclosure.

As shown in the sole FIGURE, the disclosure provides a method of continuous dyeing with reactive dyes in wet conditions, the method comprising:

1) adding fabric to a mixture of a dye liquor and an alkali through a one-bath-one-step method;

2) immersing the fabric pretreated in 1) in a padding liquor with an air film horizontal pad dyeing machine;

3) preheating the fabric after being treated in 2) at a temperature of 50-90° C.; and 4) rolling and batching the fabric after being treated in 3) at a temperature of 10-70° C. for 2-72 hours.

As an improvement, the method further comprises washing with water, soaping, washing with water, and drying the fabric after being treated in 4).

In 1), the dye liquor is an activated dye liquor, and the alkali is a color-fixation alkali. They are added in one bath thus reducing the usage of inorganic salt.

As an improvement, the activated dye comprises at least two active groups, particularly, bis(vinylsulphonyl).

As an improvement, the addition amount of the activated dye is 1-80 g/L; and the addition amount of the color-fixation alkali is 10-80 g/L, particularly, 15-35 g/L.

As an improvement, in 2), the liquid carrying rate of the fabric is set between 45 and 75%.

As an improvement, in 3), the method further comprises examining a preheating effect of the fabric; if the moisture content of the preheated fabric is 5-40%, the preheated fabric is qualified. Particularly, the moisture content of the preheated fabric is 15-30%. In this way, the fabric contains no free water, which is conducive to the rolling and batching of the fabric, preventing the migration of the dye, avoiding the color difference of the fabric, and reducing the swelling of the fabric. In addition, there is no free water at the stitching of the fabric, there is no mark at the stitching, and there is no defect in the stitching of the fabric. In the batching process, the fabric roll does not need to rotate continuously thus saving the energy consumption; in the process of rolling and batching, there is no free water in the fabric, so the dye fixation rate is increased, and the color of the fabric is deep.

As an improvement, in 4), the fabric is batched at a temperature of 35-50° C. for 4-24 hours. In the method of the disclosure, the temperature is easily achieved for the batching environment, that is, the batching can be implemented in a wide temperature range of 35-50° C. The fluctuation of the batching environment temperature can be compensated by adjusting the batching time. When the batching environment temperature is high, the batching time can be shortened; when the batching environment temperature is low, the batching time can be increased. The batching time is adjusted according to the batching environment temperature to achieve the dyeing effect of the fabric.

The application principle of the method is further explained in combination with specific examples:

Fabric: C20×16; 128×60 57" plain weave.

Dyes and auxiliaries: reactive dyes with two or more active groups, color fixing alkali (BadischeAnilin Soda Fabrik Ga, BASF), soaping agent Degussa 3S (BASF), sodium carbonate, caustic soda, thickener: Lutexal F-HIT (BASF), and industrial salt.

Production equipment: air pressure membrane horizontal pad dyeing machine (evenness calender), 633 hot air-drying room, color soaping machine, JT-T moisture meter for textile raw materials (Taizhou Jingtai Instrument Co., Ltd.), Datacolor SF 600× colorimeter (Xiamen Rapid Precision Machinery Co., Ltd.).

Test items: strength, K/S value, soaping fastness, rubbing fastness, ironing fastness, perspiration fastness, chlorine washing fastness, sunlight fastness, perspiration-sunlight fastness.

EXAMPLE 1

Provided is a method of continuous dyeing with reactive dyes in wet conditions:

Fabric: C20×16; 128×60; 57". Color: dark blue.

Raw materials: Remazol dark blue RGB, 18 g/L; Remazol red RGB, 0.5 g/L; Remazol golden RGB, 0.95 g/L.

Technology process: weighing a dye and an alkali→dissolving the dye and alkali in different vessels→adding the resulting dye liquor and the alkali solution in a mass ratio of 4:1 to a padding trough→adding a padding liquor (liquid carrying rate 65%) to the padding trough→preheating at 50-90° C. until a moisture content of fabric is 20-30%→rolling fabric synchronously→sealing the fabric with plastic film→batching at 50-90° C. for 24 hours→washing with water→soaping (Degussa 3S, 2 g/L)→washing with water→drying.

The indexes are shown in Tables 1 and 2.

TABLE 1

Comparisons of color yield under different dyeing methods

| Methods | Dark blue | |
|---|---|---|
| | K/S | Dye strength % |
| Pad-dry-pad-steam dyeing | 22.159 | 100 |
| Dyeing in wet conditions of the disclosure | 23.38 | 105.51 |

TABLE 2

Comparisons of color fasteness under different dyeing methods

| Index | | | Dark blue | |
|---|---|---|---|---|
| | | | Pad-dry-pad-steam | Dyeing in wet conditions |
| Soaping fastness (Grade) (AATCC61-2A) | Color change | | 3.0 | 3.0 |
| | Staining of white cloth | Cellulose acetate fiber | 4.5 | 4.5 |
| | | Cotton | 4.0 | 4.0 |
| | | Nylon | 4.0 | 4.0 |
| | | Polyester | 4.5 | 4.5 |
| | | Acrylic | 4.5 | 4.5 |
| | | Wool | 4.5 | 4.5 |
| Rubbing fastness (Grade) (AATCC8) | Dry friction | | 2.5 | 2.0 |
| | Wet friction | | 2.5 | 2.5 |

TABLE 2-continued

| Comparisons of color fasteness under different dyeing methods | | | | |
|---|---|---|---|---|
| | | | Dark blue | |
| Index | | | Pad-dry-pad-steam | Dyeing in wet conditions |
| Perspiration fastness (GB-T3922) | Acid | Color change | 3-4 | 3-4 |
| | | Staining of white cloth | 4 | 4 |
| | Alkali | Color change | 3-4 | 3-4 |
| | | Staining of white cloth | 4 | 4 |
| Ironing fastness (GB-T6152) | Color change by dry ironing | | 4 | 4 |
| | Color change by damp ironing | | 4-5 | 4-5 |
| Perspiration and light fastness (AATCC125) | | | 3.0− | 2.5 |
| Light fastness (AATCC16) | | | 3.5 | 3.0 |
| Color fastness to chlorine bleaching (Grade) (AATCC61-4A) | | | 1.0 | 1.0 |

As shown in Tables 1 and 2, the dyeing method of the disclosure is superior to the pad-dry-pad-steam dyeing in dyeing effect, and the color yield is increased by 5%. The color fastness can meet the requirements of pad-dry-pad-steam dyeing, and some indexes such as dry rubbing fastness, perspiration-sunlight fastness, light fastness are better than those of the pad-dry-pad-steam dyeing.

EXAMPLE 2

Provided is another method of continuous dyeing with reactive dyes in wet conditions:

Fabric: C20×16+70D; 128×68; 57". Color: blue; dark blue.

Raw Materials:

Blue (Anozol dyes): Anozol blue M-2GE, 17.2 g/L; Anozol red3BE, 1.5 g/L; Anozol yellow 3RE, 1.3 g/L.

Dark blue (Anozol dyes): Anozol dark blue L-3G, 16 g/L; Anozol red L-S, 3 g/L; Anozol yellow L-3R, 1 g/L.

Technology process: weighing a dye and an alkali→dissolving the dye and alkali in different vessels→adding the resulting dye liquor and the alkali solution in a mass ratio of 4:1 to a padding trough→adding a padding liquor (liquid carrying rate 65%) to the padding trough→preheating at 50-90° C. until a moisture content of fabric is 20-30%→rolling fabric synchronously→sealing the fabric with plastic film→batching at 50-90° C. for 24 hours→washing with water→soaping (Degussa 3S, 2 g/L)→washing with water→drying.

TABLE 3

| Comparisons of color yield of blue under different dyeing methods | | |
|---|---|---|
| | Blue | |
| Methods | K/S | Dye strength % |
| Pad-dry-pad-steam dyeing | 16.470 | 100 |
| Dyeing in wet conditions of the disclosure | 16.650 | 102.17 |

TABLE 4

| Comparisons of color fasteness of blue under different dyeing methods | | | | |
|---|---|---|---|---|
| | | | Blue | |
| Index | | | Pad-dry-pad-steam | Dyeing in wet conditions |
| Soaping fastness (Grade) (AATCC61-2A) | Color change | | 3.5 | 3.0 |
| | Staining of white cloth | Cellulose acetate fiber | 4.5 | 4.5 |
| | | Cotton | 4.5 | 4.5 |
| | | Nylon | 4.5 | 4.5 |
| | | Polyester | 4.5 | 4.5 |
| | | Acrylic | 4.5 | 4.5 |
| | | Wool | 4.5 | 4.5 |
| Rubbing fastness (Grade) (AATCC8) | Dry friction | | 3.0− | 3.0 |
| | Wet friction | | 2.5+ | 2.5 |
| Perspiration fastness (GB-T3922) | Acid | Color change | 3-4 | 3-4 |
| | | Staining of white cloth | 4 | 4− |
| | Alkali | Color change | 3-4 | 3-4 |
| | | Staining of white cloth | 4 | 4-5 |
| Ironing fastness (GB-T6152) | Color change by dry ironing | | 4 | 3-4 |
| | Color change by damp ironing | | 4-5 | 4-5 |
| Perspiration and light fastness (AATCC125) | | | 2.5 | 2.5 |
| Light fastness(AATCC16) | | | 2.5 | 2.5+ |
| Color fastness to chlorine bleaching (Grade) (AATCC61-4A) | | | 2.0 | 2.0− |

TABLE 5

| Comparisons of color yield of dark blue under different dyeing methods | | |
|---|---|---|
| | Dark blue | |
| Methods | K/S | Dye strength % |
| Pad-dry-pad-steam dyeing | 24.459 | 100 |
| Dyeing in wet conditions of the disclosure | 25.731 | 105.2 |

TABLE 6

Comparisons of color fasteness of dark blue under different dyeing methods

| Index | | | Anozol dark blue L-3G | |
|---|---|---|---|---|
| | | | Pad-dry-pad-steam | Dyeing in wet conditions |
| Soaping fastness (Grade) (AATCC61-2A) | Color change | | 3.5 | 3.5 |
| | Staining of white cloth | Cellulose acetate fiber | 4.5 | 4.5 |
| | | Cotton | 4.5 | 4.5 |
| | | Nylon | 4.5 | 4.5 |
| | | Polyester | 4.5 | 4.5 |
| | | Acrylic | 4.5 | 4.5 |
| | | Wool | 4.5 | 4.5 |
| Rubbing fastness (Grade) (AATCC8) | Dry friction | | 2.5 | 2.0 |
| | Wet friction | | 2.5+ | 2.0 |
| Perspiration fastness (GB-T3922) | Acid | Color change | 4 | 4 |
| | | Staining of white cloth | 4-5 | 4-5 |
| | Alkali | Color change | 4 | 4 |
| | | Staining of white cloth | 4 | 3-4 |
| Ironing fastness (GB-T6152) | Color change by dry ironing | | 4 | 4 |
| | Color change by damp ironing | | 4-5 | 4-5 |
| Perspiration and light fastness (AATCC125) | | | 2.5 | 3.0– |
| Light fastness(AATCC16) | | | 3.0+ | 3.5 |
| Color fastness to chlorine bleaching (Grade) (AATCC61-4A) | | | 1.0 | 1.0 |

As shown in Tables 3 and 6, the dyeing method of the disclosure is superior to the pad-dry-pad-steam dyeing in dyeing effect, and the color yield is increased by 2%. The color fastness can meet the requirements of pad-dry-pad-steam dyeing, and some indexes such as dry rubbing fastness, perspiration-sunlight fastness, light fastness are better than those of the pad-dry-pad-steam dyeing.

The continuous dyeing method with reactive dyes in wet conditions of the disclosure saves the use of inorganic salts, reduces the burden of sewage treatment, shortens the process flow, improves the product efficiency, reduces energy consumption, and has stable product quality and positive physical indexes. The method of the disclosure has the characteristics of short production cycle, strong adaptability, energy saving and environmental protection. The product produced by the method of the disclosure has full cloth surface, high market recognition rate and good economic benefit, and the disclosure provides a new production process for the reactive dye dyeing field.

It will be obvious to those skilled in the art that changes and modifications may be made, and therefore, the aim in the appended claims is to cover all such changes and modifications.

What is claimed is:

1. A method, comprising:

1) adding fabric to a mixture of a dye liquor and an alkali through a one-bath-one-step method;

2) immersing the fabric pretreated in 1) in a padding liquor with an air film horizontal pad dyeing machine;

3) preheating the fabric after being treated in 2) at a temperature of 50-90° C.; and 4) rolling and batching the fabric after being treated in 3) at a temperature of 10-70° C. for 2-72 hours.

2. The method of claim 1, further comprising washing with water, soaping, washing the fabric with clean water, and drying the fabric after being treated in 4).

3. The method of claim 1, wherein the dye liquor is an activated dye liquor, and the alkali is a color-fixation alkali.

4. The method of claim 3, wherein the activated dye comprises at least two active groups.

5. The method of claim 4, wherein the activated dye comprises bis(vinylsulphonyl).

6. The method of claim 3, wherein an addition amount of the activated dye is 1-80 g/L; and an addition amount of the color-fixation alkali is 10-80 g/L.

7. The method of claim 6, wherein the addition amount of the color-fixation alkali is 15-35 g/L.

8. The method of claim 1, wherein in 2), a liquid carrying rate of the fabric is set between 45 and 75%.

9. The method of claim 1, wherein in 3), the method further comprises examining a preheating effect of the fabric; if a moisture content of the preheated fabric is 5-40%, the preheated fabric is qualified.

10. The method of claim 9, wherein in 3), the moisture content of the preheated fabric is 15-30%.

11. The method of claim 1, wherein in 4), the fabric is batched at a temperature of 35-50° C. for 4-24 hours.

* * * * *